US005626375A

United States Patent [19]

Plett

[11] Patent Number: 5,626,375

[45] Date of Patent: May 6, 1997

[54] GATE LATCH MECHANISM

[76] Inventor: Henry Plett, 4031 Rundlehorn Drive N.E., Calgary, Alberta, Canada, T1Y 2K2

[21] Appl. No.: 571,033

[22] Filed: Dec. 12, 1995

Related U.S. Application Data

[63] Continuation of Ser. No. 227,127, Apr. 13, 1994, abandoned.

[51] Int. Cl.[6] ..... E05C 3/06

[52] U.S. Cl. ..... 292/238; 292/246; 292/136

[58] Field of Search ..... 292/236, 237, 292/189, 190, 200, DIG. 13, 135, 136, 134, 188, 100, 101, 238, 246, 143

[56] References Cited

U.S. PATENT DOCUMENTS

| | | | |
|---|---|---|---|
| 147,220 | 2/1874 | Bowman | 292/237 |
| 712,318 | 10/1902 | Moore | 292/337 |
| 1,326,554 | 12/1919 | Watson | 292/236 |
| 1,442,879 | 1/1923 | Heberling | 292/101 |
| 1,487,667 | 3/1924 | Omler | 292/189 |
| 1,688,543 | 10/1928 | Highers | 292/101 |
| 1,886,827 | 11/1932 | Mears | 292/237 |
| 1,923,873 | 8/1933 | Mears | 292/200 |
| 2,020,188 | 11/1935 | Johnson | 292/101 |
| 2,031,522 | 2/1936 | Biglin | 292/236 |
| 2,729,489 | 1/1956 | Westover | 292/143 |
| 4,062,575 | 12/1977 | Robins | 292/236 |

*Primary Examiner*—Darnell M. Boucher

[57] ABSTRACT

A non-residential door latch comprised of a serpentine rigid bar. Mounting plates for locating the bar through a typical gate such that a downwardly curving portion of the bar is exposed on one side of the gate to form a handle while an inwardly curving portion of the bar is exposed on the opposite side of the gate to form a striker. Horizontal movement of the handle creates a corresponding vertical movement of the striker. An "L" shaped support bracket incorporates an elongated slot which fits over the end of the striker and limits the vertical movement of the striker. A latch bracket mounted to the gate post incorporates an elongate slot, open at one end into which the striker falls and is captured.

5 Claims, 3 Drawing Sheets

GATE LATCH MECHANISM

This is a continuation of application Ser. No. 08/227,127, filed Apr. 13, 1994 now abandoned.

BACKGROUND

1. Field of the Invention

The present invention is directed toward the field of latching mechanisms, more specifically to a latching mechanism for use with fence gates and the like.

2. Discussion of Known Art

While the essence of a gate latch is comprised of a striker bar and plate, many variations are possible and such potential variations have been the subject of considerable inventive ingenuity over the years.

It is apparent that movement of the striker bar or the striker plate or both may be implemented in a latch to effect closure and release and inventors have experimented with each with mostly limited success.

Many of the currently available gate latches utilize a fixed bar and movable striker of the pivotal curved hook type. While such devices are operable they suffer from several disadvantages including breakage and "freezing" of the movable hook due to rust build up. The fixed bar type latches usually incorporate a bar which has one or more moderately sharp bends. This can lead to fatigue cracking and eventual breakage of the bar following repeated gate slamming.

An additional shortcoming of the currently available latches is that, for the most part, they contain many moderately squared and obtrusive edges which can lead to snagging of clothing and the like and presents the potential for personal injury.

According to one aspect the present invention relates to a gate latch apparatus comprising:

a generally S shaped solid bar having one half of the S twisted to lie in a plane substantially perpendicular to the plane of the other half;

means for mounting the bar through a gate so that a downwardly curving portion of the bar is exposed on one side of the gate and an inwardly curving portion of the bar is exposed on the opposite side of the gate and whereby horizontal movement of the downwardly curving portion of the bar results in corresponding vertical movement of the inwardly curving portion of the bar;

means for limiting the vertical movement of the inwardly curving portion of the bar; and means for latching the inwardly curving portion of the bar so that the gate is secured to a gate post.

According to another aspect the present invention relates to a latch mechanism comprising:

a generally S shaped rigid bar having a first curved end of the S twisted at substantially ninety degrees to the opposite curved end of the S;

means for threading the bar through a gate so that the respective curved portions of the bar are exposed on an inside surface and an outside surface of the gate; and means for engaging one curved end of the bar to a gate post so that the gate is securely fixed to the gate post.

OBJECTS AND ADVANTAGES

Several objects of the present invention, then, are to provide a gate latch mechanism wherein moving parts are minimized; sharp and/or obtrusive edges are reduced; sharp angles are avoided; and the useful life of the latch is significantly increased relative to the known art devices.

Additional objects and advantages of the present invention will become apparent from a consideration of the ensuing description and drawings wherein.

DESCRIPTION

Figure 1:
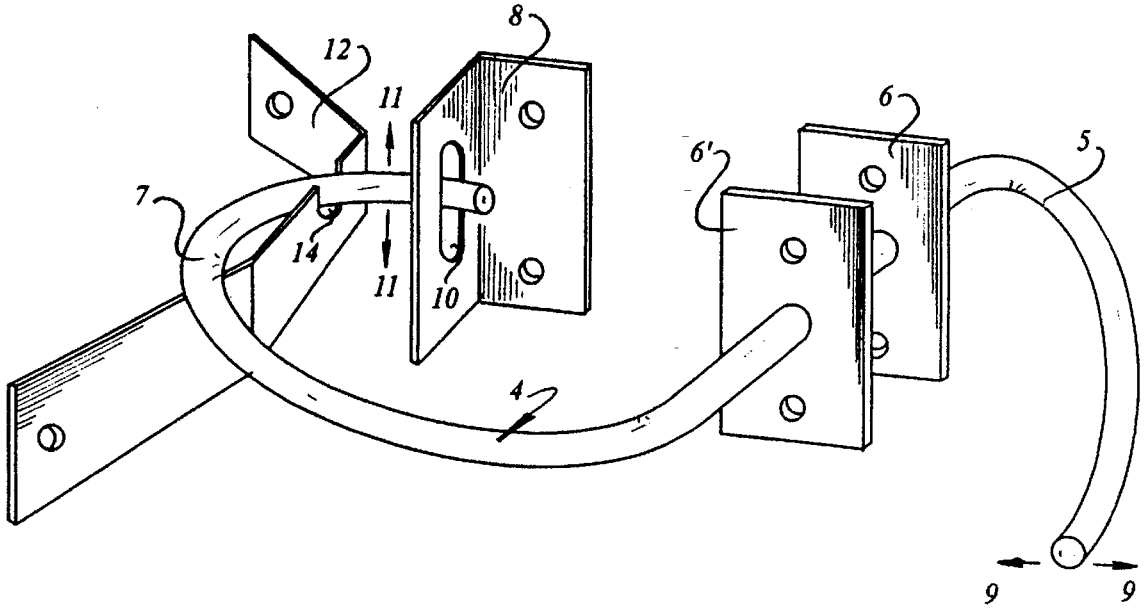
FIG. 1 is pictorial view of the latch mechanism components illustrating their relationship to each other.
Figure 2:
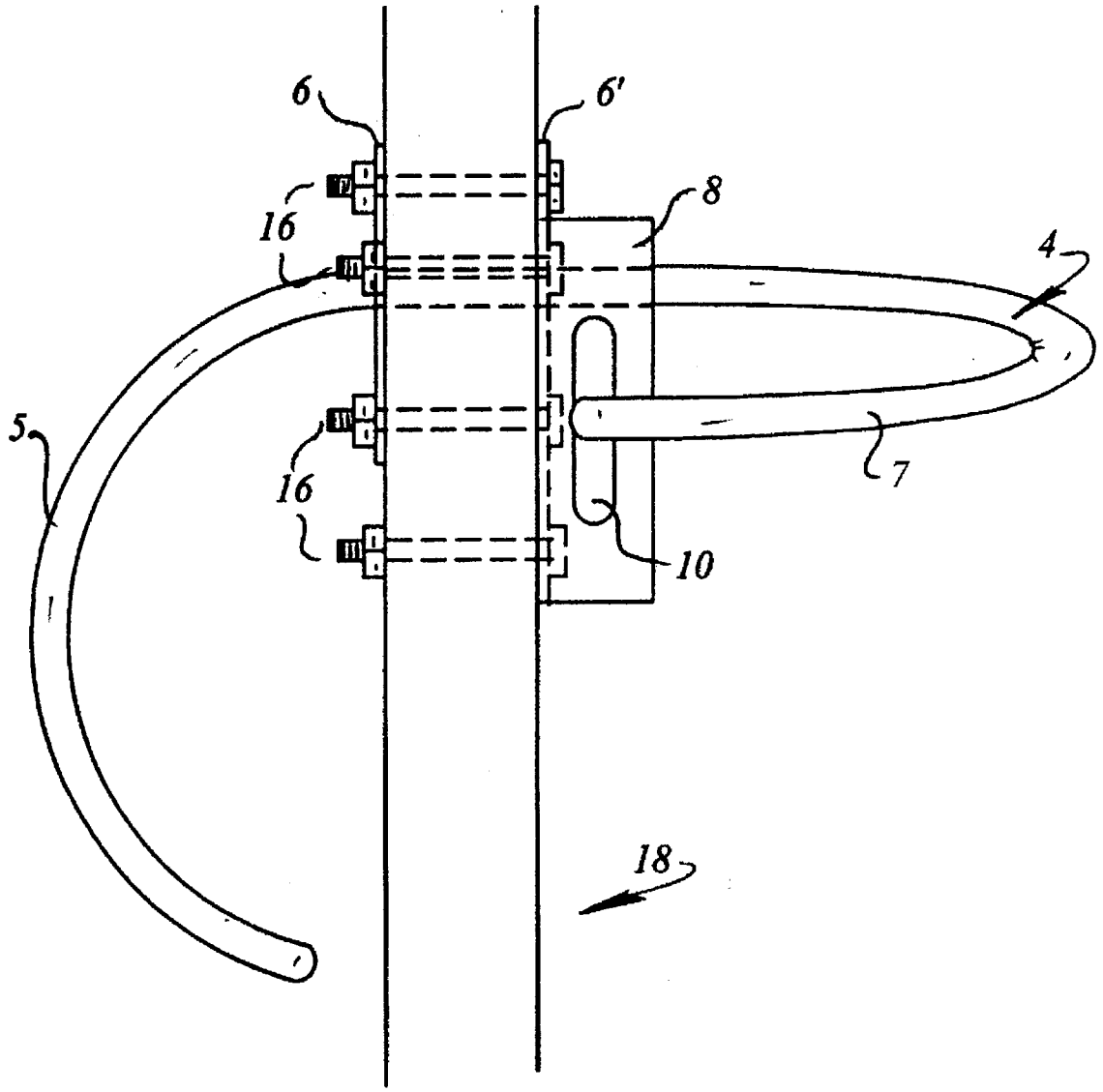
FIG. 2 is a side view of a typical installation showing the latch mechanism installed.
Figure 3:
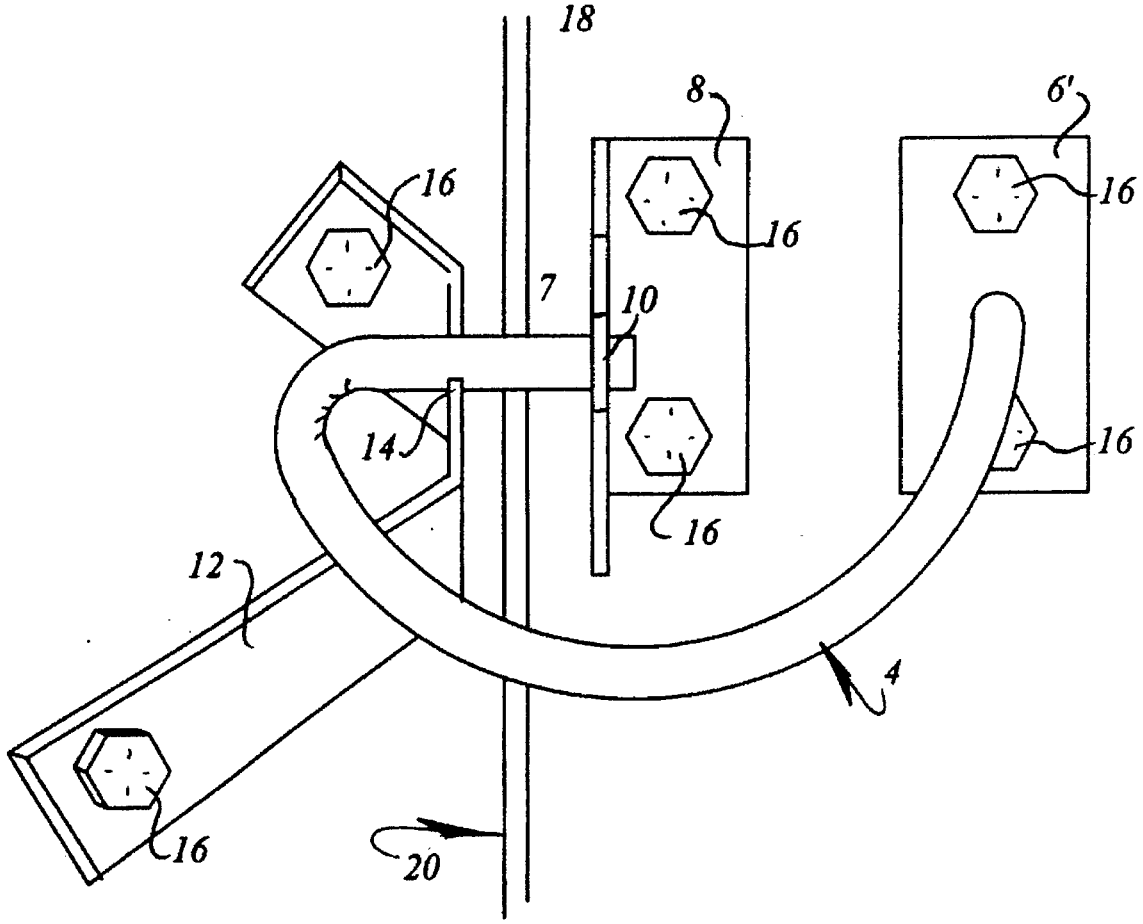
FIG. 3 is a front view of a typical installation showing the latch mechanism in a closed position.

Referring now to FIGS. 1 to 3 it may be seen that the gate latch mechanism of the present invention is comprised of an elongate, solid metal bar 4 contoured to the generalized shape of a figure "S" wherein the lower curved portion of the figure "S" 5 is twisted at substantially ninety degrees with respect to the upper curved portion of the figure "S" 7; a pair of generally rectangular, flat mounting plates 6 and 6' respectively, of robust rigid material and uniform thickness, each incorporating a substantially centered through hole of sufficient diameter to provide for a clearance fit to the diameter of the bar 4 and a pair of equally spaced through holes of sufficient diameter to accommodate conventional fastening means such as bolts and nuts;

a generally "u" shaped bracket 8 of robust rigid material and uniform thickness having an elongate slot 10 substantially centrally located on one leg of the "L" bracket 8, of sufficient dimensions to accommodate the free movement of the bar 4 within the confines of the slot 10, and a pair of equally spaced through holes located on the other leg of the "L" bracket 8 of sufficient diameter to accommodate conventional fastening means such as bolts and nuts; and an elongate, generally rectangular, flat latch bracket 12 of robust rigid material and uniform thickness having a series of bends such that one end of the bracket 12 is oriented upwards while the opposite end is oriented downwards and is approximately three times the length of the upwardly oriented end. A through hole of sufficient diameter to accommodate conventional fastening means such as bolts and nuts is located toward the outer edge of each of the upwardly and downwardly oriented bracket 12 ends. An elongate slot 14 is located substantially centrally on the central surface of the bracket 12 and extends from the upper edge of the central surface approximately half the width of the bracket 12.

Operation

The method of Operation of the present invention may be readily discerned having reference to FIGS. 2 and 3 wherein it is shown that the bar 4 is threaded through a predrilled hole in a typical gate 18 at, a height convenient to humans and at, a position close to the edge of the gate 18 such that an inwardly curving portion of the bar 4 is exposed on one side of the gate 18 and forms a striker 7 which extends beyond the gate 18 edge to align horizontally with a gate post 20, while a downwardly curving portion of the bar 4 is exposed on the opposite side of the gate 18 in a vertical position relative to the surface of the gate 18 and forms a handle 5.

The mounting plate 6 is inserted over the handle 5 and placed in intimate contact with the surface of the gate 18. The mounting plate 6' is inserted over the striker 7 and placed in intimate contact with the opposite surface of the gate 18. Both mounting plates, 6 and 6' respectively are affixed to each other by insertion of bolts 16 through predrilled holes in the gate 18 and through the respective mounting holes in the plates, 6 and 6' respectively where the bolts 16 are locked in position by the application of appropriate nuts. The plates, 6 and 6' respectively, thus mounted, trap the bar 4 within the confines of the gate 18 and further serve as bearing surfaces for limited rotation of the bar 4 within the confines of the gate 18.

The elongate slot 10 in the "L" shaped bracket 8 is inserted over the end of the striker 7 and placed in intimate contact with the gate 18 where the bracket 8 is securely affixed to the gate 18 surface by the insertion of bolts 16 through predrilled holes in the gate 18 and the mounting holes in the bracket 8 and maintained in position by the application of appropriate nuts.

The latch bracket 12 is affixed to the gate post 20 by means of bolts 16 such that the elongate slot 14 of the bracket 12 captures a section of the striker 7.

The handle 5, when moved horizontally 9 to the left or right results in a corresponding vertical 11 up and down movement of the striker 7, which vertical 11 movement is restricted to the dimensions of the elongate slot 10 in the bracket 8. The mounting position of the latch bracket 12 is such that the vertical 11 movement of the striker 7 serves to engage and disengage the striker 7 in the latch bracket slot 14 thus providing latch action release and closure.

It should be realized that the relative positioning of each of the components of the latch mechanism on both the gate 18 and gate post 20 is of significant importance to the satisfactory operation of the present invention and such positioning must be carefully considered during installation.

Summary Ramifications and Scope

From the above description it can be seen that the preferred embodiment of the present invention provides a strong, substantially snag free gate latch mechanism which has few moving parts to fail and is relatively simple to install.

It will be understood that the above description should not be construed as limiting the scope of the present invention but rather as setting forth the presently preferred embodiment. Several variations of the present invention are possible without departure from the spirit of the invention and the scope of the invention should thus be determined by the appended claims and their legal equivalents.

I claim:

1. A gate latching mechanism comprising:

solid bar means having an exaggerated "S" curvature and wherein a first half of the bar means is twisted to lie in a plane substantially perpendicular to the plane of the second half;

means for mounting the bar means through a gate so that the first half of the bar means is exposed on one side of the gate in a plane substantially vertical to the gate and the second half of the bar means is exposed on the other side of the gate in a plane substantially horizontal to the gate;

keeper plate means, the body thereof defining an elongate, substantially vertical opening therein, the keeper plate means mounted to the gate and in alignment with the end of the second half of the bar means so as to capture the end of the bar means within the confines of the plate means vertical opening limiting vertical movement of the bar means; and striker plate means having a notch therein, the striker plate means mounted to a gate post and positioned to capture a portion of the body of the second half of the bar means within the notch when gate is closed with respect to the gate post, the striker plate means further having a ramping leading edge in direct alignment of the body of the bar means with the striker plate notch as the gate is moved toward closure with the gate post a portion of the body of the second half resting on the leading edge when the gate is in a closed position to compensate for gate sag.

2. Gate latch mechanism resistant to gate sag comprising;

"S" shaped solid bar means mounted through the body of a gate, the bar means having one half of the S twisted to lie in a plane substantially perpendicular to the plane of the other half to form a substantially vertical handle on one side of the gate and a substantially horizontal handle on the other side of the gate whereby horizontal movement of the vertical handle results in corresponding vertical movement of the horizontal handle;

means for limiting the horizontal and vertical movement of the handles;

latching means mounted to a gate post adjacent the gate for engaging a first portion of the body of the horizontal handle as the gate is closed with respect to the gate post; and ramping means for guiding the portion of the body of the horizontal handle into engagement with the latching means as the gate is moved toward closure with the gate post thereby compensating for gate sag a second portion of the body of the horizontal handle resting on the ramping means when the gate is in a closed position.

3. The structure of claim 2 wherein the limiting means comprises a keeper plate, the body thereof defining an elongate, substantially vertical opening therein, the keeper plate mounted to the gate and in alignment with the end of the horizontal handle so as to capture the end of the handle within the confines of the plate vertical opening.

4. The structure of claim 2 wherein the latching means comprises a striker plate having a notch therein, the notch dimensioned to accommodate insertion of the first portion of the horizontal handle therein.

5. The structure of claim 2 wherein the ramping means comprises a portion of the latching means consisting of an inclined plane.

* * * * *